US009470030B2

(12) United States Patent
Denny

(10) Patent No.: US 9,470,030 B2
(45) Date of Patent: Oct. 18, 2016

(54) SELF-ALIGNING COVER FOR AN SST

(71) Applicant: NCR CORPORATION, Duluth, GA (US)

(72) Inventor: Ian M Denny, Scotland (GB)

(73) Assignee: NCR CORPORATION, Duluth, GA (US)

( * ) Notice: Subject to any disclaimer, the term of this patent is extended or adjusted under 35 U.S.C. 154(b) by 627 days.

(21) Appl. No.: 13/718,710

(22) Filed: Dec. 18, 2012

(65) Prior Publication Data

US 2014/0165473 A1 Jun. 19, 2014

(51) Int. Cl.
*E05D 15/58* (2006.01)
*G07F 19/00* (2006.01)

(52) U.S. Cl.
CPC ..... *E05D 15/582* (2013.01); *G07F 19/205* (2013.01); *Y10T 16/5457* (2015.01); *Y10T 29/49895* (2015.01)

(58) Field of Classification Search
CPC . E05D 15/582; G07F 19/205; Y10T 16/299; Y10T 16/281; Y10T 16/283; Y10T 16/286; Y10T 16/62; Y10T 16/53834; Y10T 16/53835; Y10T 16/53885; Y10T 16/5457; Y10T 29/49895; E05F 3/02; E06B 3/32; E05Y 2900/20
USPC ..... 312/325, 326, 319.2, 327, 328
See application file for complete search history.

(56) References Cited

U.S. PATENT DOCUMENTS 3,771,847 A * 11/1973 Aylworth ..... 312/245
4,516,813 A * 5/1985 Sekerich ..... 312/323
4,845,905 A * 7/1989 Frank ..... E04D 13/0354 292/278
4,899,420 A * 2/1990 Bye ..... E05D 7/121 16/16
5,067,277 A * 11/1991 Magalotti ..... F16F 9/0263 188/300
5,171,078 A * 12/1992 Oslin et al. ..... 312/325
5,401,096 A * 3/1995 Stang ..... 312/319.2
5,483,047 A * 1/1996 Ramachandran ..... G07F 19/20 235/379
5,524,979 A * 6/1996 Carson et al. ..... 312/319.2
5,758,937 A * 6/1998 Lammens et al. ..... 312/328
5,813,914 A * 9/1998 McKay et al. ..... 463/46
5,971,514 A * 10/1999 Hayakawa ..... 312/319.2
6,032,420 A * 3/2000 Daoud ..... 52/67
7,810,715 B2 * 10/2010 Herd et al. ..... 235/379
8,839,559 B2 * 9/2014 Neff ..... E05F 3/02 49/324
2001/0007163 A1 * 7/2001 Alonso ..... E05F 3/108 16/58
2004/0004421 A1 * 1/2004 Han ..... 312/404
2012/0110910 A1 * 5/2012 Neff ..... E05F 3/02 49/358

* cited by examiner

*Primary Examiner* — Daniel J Troy
*Assistant Examiner* — Hiwot Tefera
(74) *Attorney, Agent, or Firm* — Schwegman, Lundberg & Woessner

(57) ABSTRACT

A method and apparatus are disclosed for aligning a cover with an opening in a housing. The apparatus includes at least one hinge member securable to a housing and moveable between open and closed positions about a hinge axis, at least one attachment member for mounting a cover member to the moveable hinge member, and at least one alignment member for guiding the cover member into an aligned position when the cover member is moved with the hinge member towards the closed position, wherein the attachment member is adapted to allow the cover member to move in a perpendicular direction relative to the hinge axis.

5 Claims, 4 Drawing Sheets

SELF-ALIGNING COVER FOR AN SST

FIELD OF THE INVENTION

The present invention relates to a method and apparatus for aligning a cover with respect to an opening in a housing. In particular, but not exclusively, the present invention relates to the self-alignment of a cover of a Self Service Terminal (SST) (such as an ATM) with respect to an opening in the SST. Alignment occurs automatically when the cover member is moved from an open position to a closed position.

Known SSTs, such as ATMs, typically include one or more openings in a main enclosure for providing authorized personnel access inside the ATM. Such access is often required for replenishing printer consumables, removing captured bank cards, updating software/hardware and for general servicing and maintenance. Naturally the opening(s) must be closeable for security reasons and to avoid ingress of contaminants. Typically, a cover is hingedly mounted to the main enclosure to cover an opening of the ATM when in a closed position and allow access through the opening when in an open position. A conventional hinge is typically used to attach the cover to the main enclosure of the ATM so as to only move about a hinge axis between closed and open positions. The hinge member is fixed to the cover member and the enclosure housing so the cover member is constrained in all directions and rotations relative to the hinge member.

However, in light of relatively low manufacturing tolerances and component wear and failure over time, misalignment problems are known to occur between the cover and the opening in the housing.

Such misalignment may cause media jams where the cover member includes a working part such as a media slot which must align with an opening in the housing. For example, the cover may be a user interface or fascia of an ATM and comprise a slot, pocket or shutter for accepting/dispensing banks notes, receipts or cards.

Such misalignment is also visibly unappealing to a customer and can portray a lack of quality and/or maintenance to the customer. The misalignment can cause frictional problems which make opening and closing the cover member difficult for authorized personnel. Furthermore, the misalignment can cause undesirable wear of the hinge and any additional parts which engage with the enclosure, such as a locking member. In addition, such misalignment may allow unauthorized access to the opening and/or allow ingress of contaminants, such as rainwater and dirt, into the ATM via the opening, particularly where the ATM is located outside a building.

Such misalignment requires corrective action and, as a result, the ATM will be marked as out-of-service which can lead to inefficient downtime and a reduced degree of customer satisfaction.

SUMMARY OF THE INVENTION

It is an aim of the present invention to at least partly mitigate the above-mentioned problems.

It is an aim of certain embodiments of the present invention to provide a method and apparatus for preventing misalignment of a cover relative to an opening in a housing when the cover moves from an open position to a closed position.

It is an aim of certain embodiments of the present invention to provide a mechanism by which a cover is automatically aligned into a desired configuration when a previously open cover is closed.

It is an aim of certain embodiments of the present invention to prevent frictional problems caused by misalignment between a cover and an opening in a housing which otherwise make it difficult to open and close the cover.

According to a first aspect of the present invention there is provided apparatus for aligning a cover member with respect to an opening in a housing, comprising:

at least one hinge member securable to a housing and moveable between open and closed positions about a hinge axis;

at least one attachment member for mounting a cover member to the moveable hinge member; and at least one alignment member for guiding the cover member into an aligned position when the cover member is moved with the hinge member towards the closed position; wherein the attachment member is adapted to allow the cover member to move in a perpendicular direction relative to the hinge axis.

Aptly, the attachment member comprises at least one bearing.

Aptly, the at least one bearing comprises at least one proximal bearing and at least one distal bearing relative to the hinge axis.

Aptly, the at least one hinge member comprises at least two axially spaced apart elongate hinge members, each hinge member being moveable about the hinge axis and having at least one proximal bearing and at least one distal bearing associated therewith.

Aptly. the at least one hinge member comprises a single sheet-like hinge member having at least two proximal bearings and at least two distal bearings associated therewith, wherein each bearing is located in a corner region of the hinge member. Aptly, the apparatus further comprises an intermediate member attached to the at least one hinge member and with which the at least one bearing slideably engages.

Aptly, the intermediate member comprises a frame assembly being made up of at least two cross members and at least a pair of side members with which a corresponding bearing slideably engages.

Aptly, each side member comprises a channel for its corresponding bearing to slideably engage.

Aptly, the at least one bearing comprises a nylon bush.

Aptly, the alignment member extends outwardly from the cover member towards the housing for engagement with a receptacle of the housing and is provided distal to the hinge axis.

Aptly, the receptacle comprises a funnel-like opening to receive and guide the alignment member when the cover member is moved with the hinge member towards the closed position.

Aptly, the alignment member is lockable in the receptacle.

Aptly, the apparatus further comprises an actuator for biasing the at least one hinge member towards the open position.

Aptly, the at least one hinge member comprises an attachment portion for the actuator to pivotally attach and support the cover member when in the open position.

Aptly, the attachment portion is provided proximal the hinge axis such that when the cover member is in the open position the actuator acts perpendicularly to the cover member.

Aptly, the actuator comprises a gas strut.

According to a second aspect of the present invention there is provided a self-service terminal (SST) comprising a safe enclosure housing and apparatus for aligning a fascia of the SST with respect to an opening in the safe enclosure housing, wherein the apparatus comprises:

at least one hinge member securable to a housing and moveable between open and closed positions about a hinge axis;

at least one attachment member for mounting a cover member to the moveable hinge member; and at least one alignment member for guiding the cover member into an aligned position when the cover member is moved with the hinge member towards the closed position; wherein the attachment member is adapted to allow the cover member to move in a perpendicular direction relative to the hinge axis.

The self-service terminal may comprise an automated teller machine.

According to a third aspect of the present invention there is provided a method of aligning a cover with an opening of a housing, comprising:

securing at least one hinge member to a housing, wherein the hinge member is moveable about a hinge axis between open and closed positions relative to an opening in the housing;

mounting a cover member to the hinge member to be slideable relative to the hinge member in a direction perpendicular to the hinge axis; and providing an alignment member on the cover member or housing, distal to the hinge axis, for guiding the cover member into an aligned position when the cover member is moved with the hinge member towards the closed position.

Aptly, the method further comprising one or more of the following:

providing at least one bearing between the cover member and the at least one hinge member;

providing an intermediate member on the at least one hinge member for at least one bearing to slideably engage with;

providing an actuator for biasing the at least one hinge member towards the open position; and providing a receptacle on the other of the cover member or housing for receiving and guiding the alignment member when the cover member is moved with the hinge member towards the closed position.

According to a fourth aspect of the present invention there is provided apparatus for covering an opening in a housing, comprising:

a cover member mounted to allow movement of the cover member relative to the housing as the cover member is guided into an aligned position in which the cover member closes the opening.

Certain embodiments of the present invention provide the advantage that a cover member is able to move in a perpendicular direction, relative to a hinge axis of a hinge member on which the cover member is attached, when the cover member is guided into an aligned position when moving with the hinge member towards a closed position relative to an opening. As the cover member is moved towards the closed position, it is guided into an aligned position by the alignment member and if any misalignment between the cover member and opening exists, the cover member may move relative to the hinge member to self-align itself with the opening in the housing. Such an arrangement provides for consistent, automatic and accurate alignment of a cover member relative to an opening in a housing when the cover member is moved towards a closed position.

Certain embodiments of the present invention provide the advantage that a user interface or fascia of an SST and comprising a slot, pocket or shutter for accepting/dispensing banks notes, receipts or cards is always aligned with an opening in a housing of the SST to thereby prevent undesirable media jams.

Certain embodiments of the present invention prevent frictional problems caused by misalignment between a cover member and an opening in a housing which otherwise make it difficult to open and close the cover member. Furthermore, undesirable wear of the hinge and additional parts otherwise caused by such misalignment is prevented.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
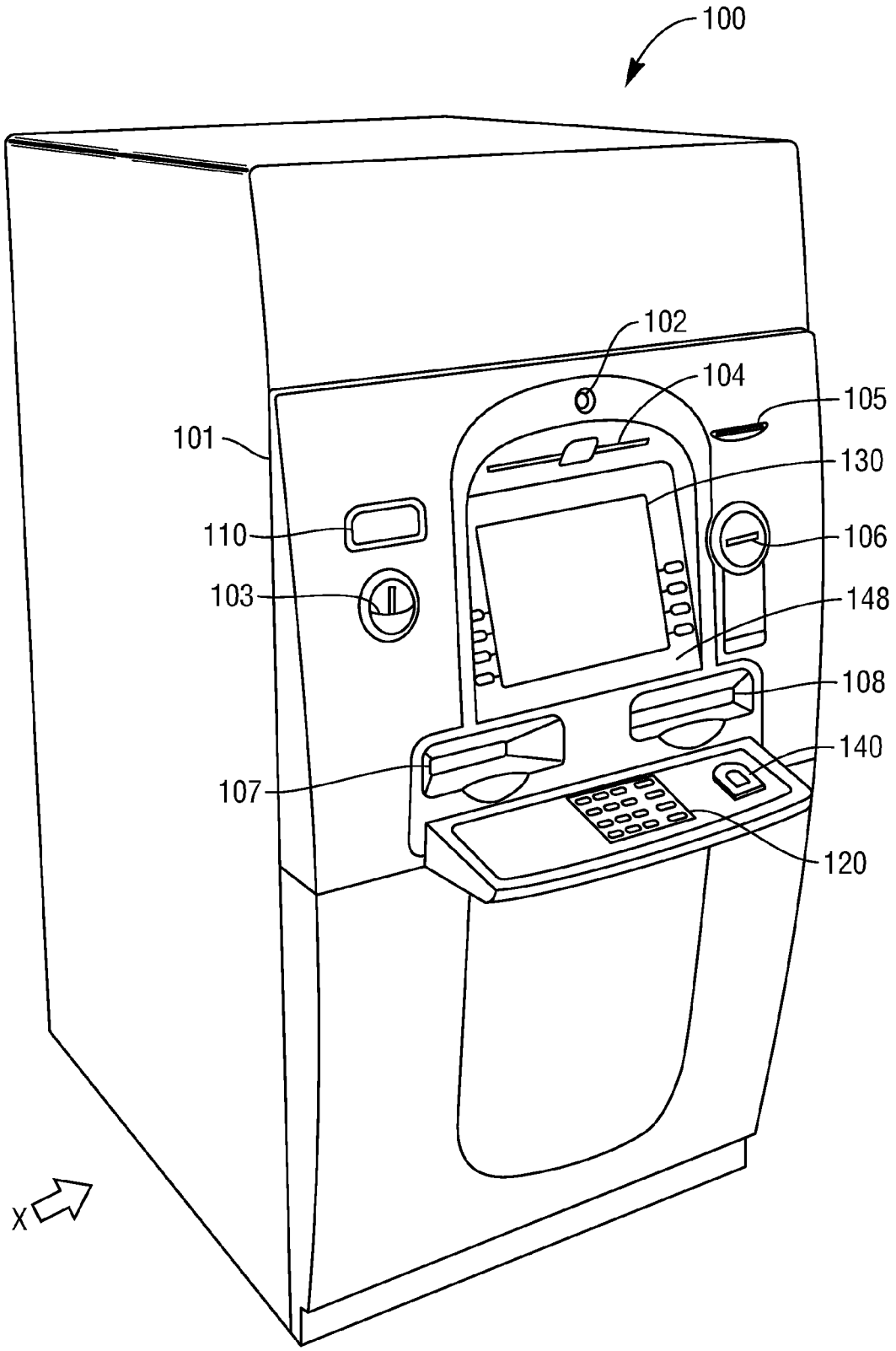
FIG. 1 illustrates a self-service terminal in the form of an ATM according to one embodiment of the present invention.

In the drawings like reference numerals refer to like parts.

FIG. 1 illustrates a self-service terminal in the form of an Automated Teller Machine (ATM) 100 according to an embodiment of the present invention. It will be appreciated that certain embodiments of the present invention are applicable to a wide variety of terminals which include an opening which is closeable by a cover. The ATM 100 includes a front panel 101 coupled to a chassis (not shown). The panel 101 defines an aperture 102 through which a camera (not shown) images a customer of the ATM 100. The panel 101 also defines a number of slots for receiving and dispensing media items and a tray 103 into which coins can be dispensed. The slots include a statement output slot 104, a receipt slot 105, a card reader slot 106, a cash dispense slot 107, a cash and check deposit slot 108 and a branding badge 110. The slots and tray are arranged such that the slots and tray align with corresponding ATM modules mounted within the chassis of the ATM 100.

The panel 101 provides a user interface for allowing an ATM customer to execute a transaction. The panel 101 includes an encrypting keyboard 120 for a customer to enter transaction details. A display 130 is provided for presenting screens to a customer. A fingerprint reader 140 is provided for reading a fingerprint of a customer to identify the customer.

The display 130 is surrounded and supported by a fascia 148 which covers an opening in the panel 101 for access inside the ATM 100. Such access is often required for replenishing printer consumables, removing captured bank cards, updating software/hardware and for general servicing and maintenance. Naturally the opening must be closeable for security reasons and to avoid ingress of contaminants. The fascia/opening interface may be sealed when the fascia is in a closed position to prevent such ingress of contaminants, such as rainwater where the ATM 100 is located outside and subject to the elements.

Figure 2:
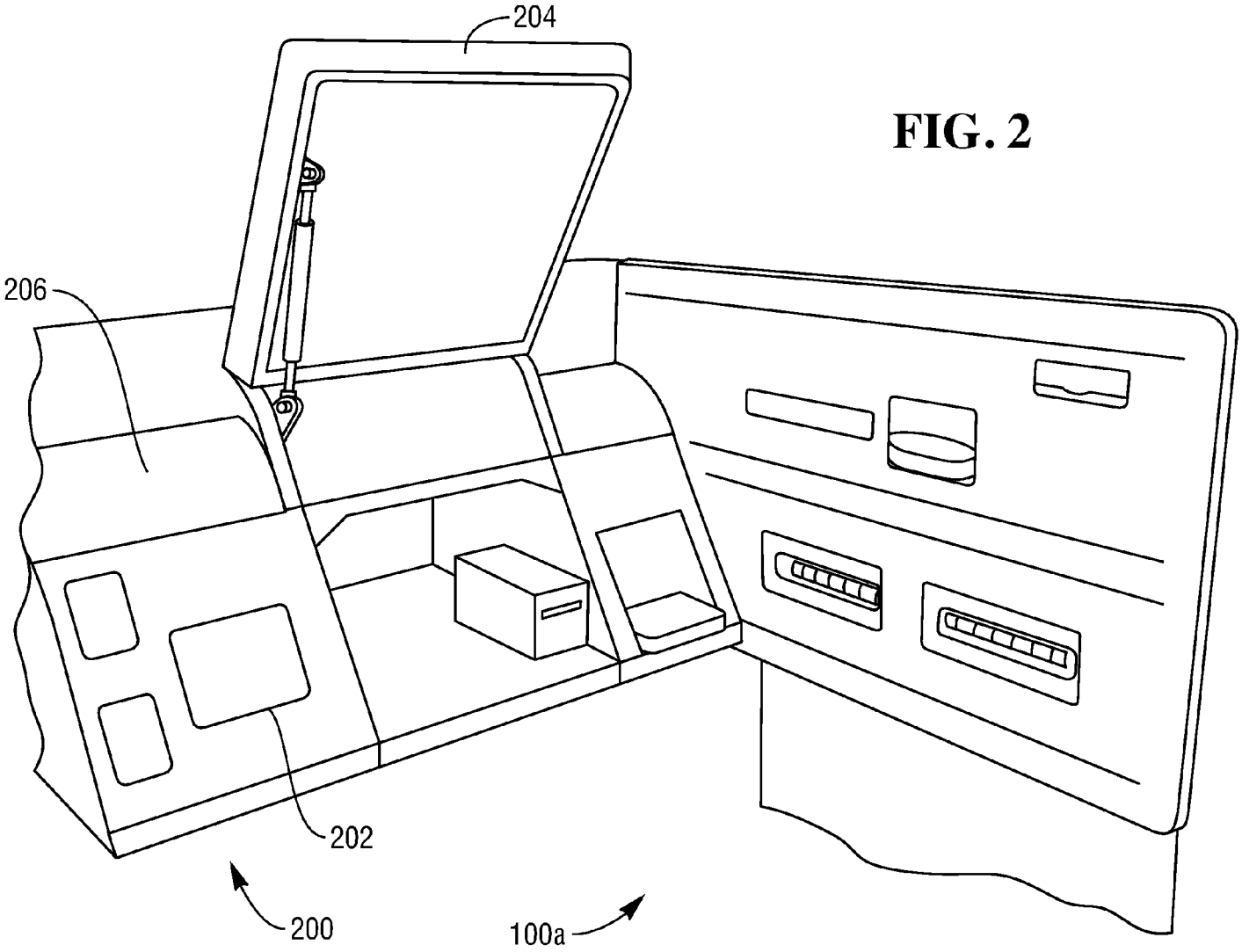
FIG. 2 illustrates a self-service terminal in the form of an ATM including an additional user interface mounted to a side thereof, wherein the additional user interface includes apparatus according to one embodiment of the present invention.

An alternative embodiment of the present invention is shown in FIG. 2. An additional user interface 200 is cantilevered from the side of an ATM 100*a*. The user interface 200 includes a media item slot 202 and a fascia 204 which is shown in an open position relative to an opening in a housing 206 of the user interface 200.

Figure 3:
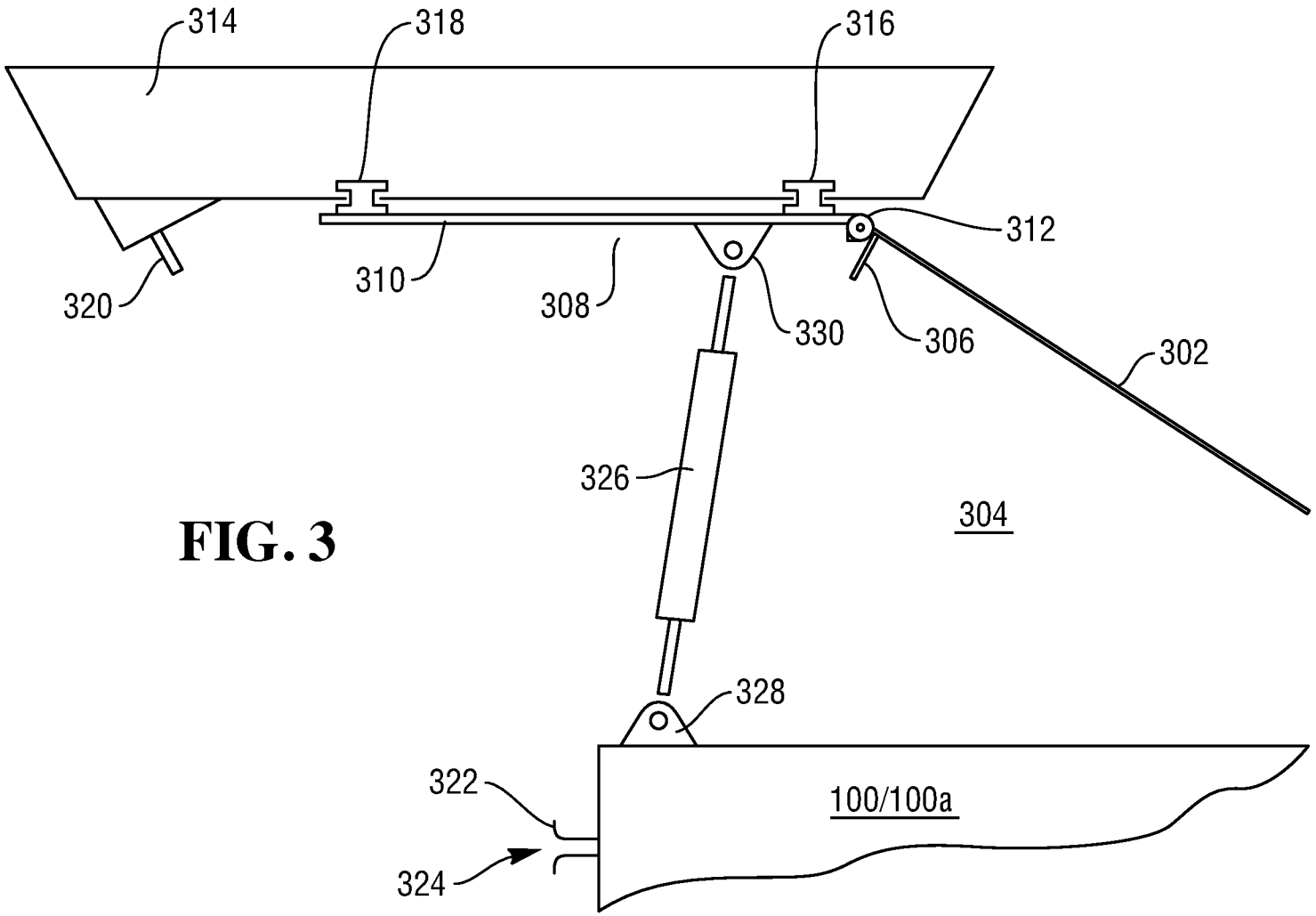
FIG. 3 illustrates a schematic diagram of an embodiment of the present invention, wherein the fascia is in an open position.
Figure 4:
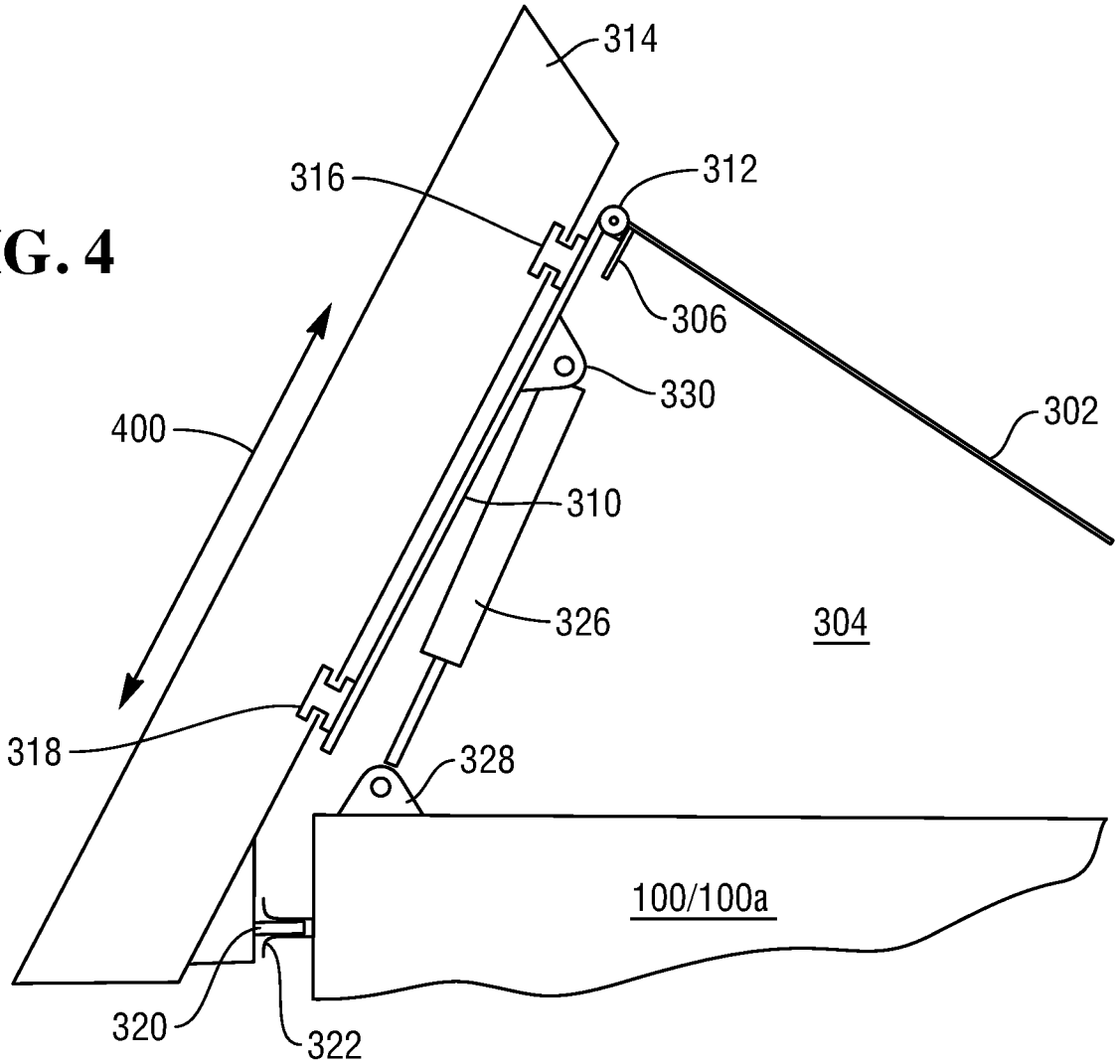
FIG. 4 illustrates a schematic diagram of an embodiment of the present invention, wherein the fascia is in a closed and aligned position.

FIGS. 3 and 4 illustrate an upper portion of an SST (such as the ATM 100 or 100*a*) comprising a safe enclosure housing 302 having an opening 304. The opening 304 is for use by authorized personnel to access one or more modules (not shown) housed in the SST, such as a controller module, customer display, card read/writer module, printer module, cash dispenser module, journal printer module, network connection module, and operator panel module.

A fixed part 306 of a hinge member 308 is attached to the safe enclosure housing 302. A moveable part 310 of the hinge member is free to move about a hinge axis 312 provided proximal an upper edge of the opening 304.

A fascia 314 is mounted to the moveable part 310 of the hinge member 308 by an upper nylon bush 316 and a lower nylon bush 318. The bushes 316, 318 are attached to the fascia 314 and slideably engage with the moveable part 310 of the hinge member 308 to allow the fascia 314 to move relative to the hinge member 308 in a direction perpendicular to the hinge axis 312, as shown by arrow 400, when the fascia 314 and moveable hinge part 310 are moved towards the closed position, as shown in FIG. 4.

Referring again to FIG. 3, an alignment pin 320 extends outwardly from the fascia 314 proximal a lower edge of the fascia 314. Aptly, the fascia 314 is substantially square or rectangular and an alignment pin 320 is provided at each lower corner of the fascia 314. A receptacle 322 is provided on the safe enclosure housing 302 for receiving and guiding each alignment pin 320 as the fascia 314 moves with the hinge member 308 towards a closed position. Each receptacle 322 includes a funnel-like opening 324 to help receive and guide the alignment pin 320.

As the fascia 314 is moved with the hinge member 308 from an open position to a closed position, each alignment pin 320 is received and guided by its corresponding receptacle 322 to move the fascia 314 relative to the hinge member 308 and the housing 302 into a desired aligned position with the opening 304. Such an aligned position of the fascia 314 may align a media slot or pocket (not shown) of the fascia with a corresponding media opening of a module (not shown) housed in the SST, for example.

The moveable part 310 of the hinge member 308 is substantially elongate with respect to the fixed part 306 to thereby sufficiently support the fascia mounted thereon. The hinge member 308 may be two spaced apart hinge members sharing the same hinge axis 312 or may be a single sheet-like hinge member.

At least one gas strut 326, or similar, is rotatably attached at a first end to a lug 328 of the safe enclosure housing 302. A second end of the gas strut 326 is rotatably attached to a lug 330 of the hinge member 308. The gas strut 326 supports the hinge member 308 and fascia 314 when in the open position to allow an authorized person to access inside the SST without having to hold open the fascia 314. The gas strut 326 may also urge the hinge member 308 towards the open position to automatically move the hinge member 308 and fascia 314 towards the open position.

The fascia 314 may include a screen, keypad and an aperture for depositing and/or dispensing items of media, such as bank notes, for example. The fascia aperture may correspond with an aperture of a module housed in the opening of the SST, such as a shutter of a cash dispenser module. The present invention provides for reliable and safe media entry and exit through the fascia 314 and allows a common user interface or fascia 314 to be used whilst securing the bulky shutters to the safe enclosure housing of the SST rather than on the fascia itself. In turn, a relatively small and lightweight fascia may be implemented for both front access (F/A) and rear access (R/A) variants of SST.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for aligning a cover member with respect to an opening in a housing, comprising:

at least one hinge member securable to a housing and moveable between open and closed positions about a hinge axis;

at least one attachment member for mounting a cover member to the moveable hinge member, wherein the attachment member comprises at least one bearing, and wherein the at least one bearing comprises at least one proximal bearing and at least one distal bearing relative to the hinge axis, and wherein the at least one hinge member comprises a single sheet-like hinge member having at least two proximal bearings and at least two distal bearings associated therewith, wherein each bearing is located in a corner region of the hinge member;

a gas strut rotatably attached at a first end to the housing and the gas strut rotatably attached to the at least one hinge member, wherein the gas strut configured for supporting the at least one hinge member and the cover member when the cover member is in the open position and the gas strut configured for urging the at least one hinge member towards the open position for automatically moving the at least one hinge member and the cover member towards the open position; and at least one alignment member for guiding the cover member into an aligned position when the cover member is moved with the hinge member towards the closed position, wherein the at least one alignment member is an alignment pin adapted to be received by a receptacle when the housing is in the closed position, and wherein the receptacle includes a funnel opening; wherein the attachment member is adapted to allow the cover member to move in a perpendicular direction relative to the hinge axis.

2. The apparatus as claimed in claim 1, further comprising an intermediate member attached to the at least one hinge member and with which the at least one bearing slideably engages.

3. The apparatus as claimed in claim 2, wherein the intermediate member comprises a frame assembly being made up of at least two cross members and at least a pair of side members with which a corresponding bearing slideably engages.

4. The apparatus as claimed in claim 1, wherein the alignment member extends outwardly from the cover member towards the housing for engagement with the receptacle of the housing and is provided distal to the hinge axis.

5. A self-service terminal (SST) comprising a safe enclosure housing and the apparatus as claimed in claim 1, wherein the opening is an opening in the safe enclosure housing and the cover member is a fascia of the SST.

* * * * *